US007922319B2

(12) United States Patent
Morimoto et al.

(10) Patent No.: US 7,922,319 B2
(45) Date of Patent: Apr. 12, 2011

(54) FIXING DEVICE OF SHIELD PLATE, RECORDING APPARATUS AND LIQUID EJECTING APPARATUS

(75) Inventors: Mitsuru Morimoto, Kitakyusyu (JP); Mikinobu Abe, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 1084 days.

(21) Appl. No.: 11/678,265

(22) Filed: Feb. 23, 2007

(65) Prior Publication Data

US 2007/0202745 A1 Aug. 30, 2007

(30) Foreign Application Priority Data

Feb. 24, 2006 (JP) ..... 2006-049394

(51) Int. Cl.
*B41J 2/01* (2006.01)
*B41J 29/13* (2006.01)

(52) U.S. Cl. ..... 347/108; 347/109; 347/101

(58) Field of Classification Search ..... 347/108, 347/109, 101

See application file for complete search history.

(56) References Cited

U.S. PATENT DOCUMENTS

| | | | | |
|---|---|---|---|---|
| 5,134,547 | A | 7/1992 | Takamizawa | |
| 7,690,785 | B2 * | 4/2010 | Silverbrook | 347/108 |
| 2002/0024578 | A1 * | 2/2002 | Yamashita | 347/108 |
| 2005/0248647 | A1 * | 11/2005 | Tanaami et al. | 347/108 |
| 2006/0246866 | A1 * | 11/2006 | Nakagawa et al. | 455/301 |

FOREIGN PATENT DOCUMENTS

| | | | |
|---|---|---|---|
| JP | 03-048499 | A | 3/1991 |
| JP | 06-314002 | A | 11/1994 |
| JP | 09-116288 | A | 5/1997 |
| JP | 3054017 | U | 11/1998 |
| JP | 2004-205714 | | 7/2004 |
| JP | 2004-219237 | | 8/2004 |

* cited by examiner

*Primary Examiner* — Manish S Shah
(74) *Attorney, Agent, or Firm* — Workman Nydegger

(57) ABSTRACT

A shield plate fixing device of an electronic apparatus includes a mechanical section for performing operation in a main body housing, an electronic substrate for controlling operation shielded by two upper and lower shield plates above the mechanical section, and an upper housing for sealing an upper opening of the main body housing above the electronic substrate. The mechanical section, the electronic substrate, and the upper housing are respectively placed in a stacked manner. The upper shield plate is directly fixed to the main body housing, so as to reduce tolerance accumulation in the assembled electronic apparatus.

7 Claims, 12 Drawing Sheets

FIXING DEVICE OF SHIELD PLATE, RECORDING APPARATUS AND LIQUID EJECTING APPARATUS

BACKGROUND

1. Technical Field

The present invention relates to recording apparatuses and liquid ejecting apparatuses. More specifically, the present invention relates to shield plate fixing device that reduces tolerance accumulation in an assembled apparatus.

2. Related Art

A conventional electronic apparatus, such as a recording apparatus or a liquid ejecting apparatus includes a main body housing designed to create the overall appearance of the electronic apparatus, a mechanical section for performing operation, an electronic substrate for controlling operation, and an upper housing for sealing an upper opening of the main body housing. Further, shield plates are provided above and below the electronic substrate to provide a shielding effect from the electromagnetic wave emitted from the electronic apparatus mounted on the electronic substrate. Each of the components constituting the electronic apparatus are arranged and combined in a stacked manner in the following order:

(1) the main body housing (specifically, a bottom plate of the main body housing), (2) the mechanical section, (3) the lower shield plate, (4) the electronic substrate, (5) the upper shield plate, and (6) the upper housing from the lower side.

Further, the connecting structure between each of the above components are described below. As schematically shown in FIG. 8B, an upper housing 7 and an upper shield plate 21 are connected by a first connecting member and the upper shield plate 21 is integrated with a lower shield plate 22 positioned below through an electronic substrate 23. Further, the lower shield plate 22 and a mechanical section 20 are connected by a third connecting member 33, and the mechanical section 20 and a main body housing 4 are connected by a fourth connecting member 34. An example of the connecting structure between each constituting member may be adopted in a recording apparatus such as an ink jet printer as shown in the electronic apparatus shown in JP-A-2004-219237.

Typically, using a fixation structure such as the one described above results in tolerance accumulation as the number of the components increases, since the component tolerance of each component and the composition tolerance between joined components cumulatively accumulate. As a result of tolerance accumulation, the fitting position of the upper housing is often misaligned, requiring that the fitting position of the upper housing needs to be adjusted so as not to disfigure the appearance of the upper housing, particularly when the upper housing contributes to the overall appearance of the apparatus. Unfortunately, this readjusting enormously complicates the process of fitting the upper housing into position. In addition, when the upper housing is an operation panel in which an operating or command buttons are fitted for initiating the operations within the electronic apparatus, any variation in the fitting position of the operation panel may cause operation fault in the operating button, depending on the structure of the operating button.

BRIEF SUMMARY OF THE INVENTION

One advantage of some aspects of the invention is reduced variation of the fitting position of an upper housing generated by cumulative tolerance caused by a fixation structure between each of the components of the electronic apparatus. Consequently, a shield plate fixing device is provided which facilitates the adjustment of a fitting position of the upper housing, providing a uniform and beautiful appearance in the electronic apparatus. Additionally, the operation of mounting components attached to the upper housing may be more uniform, while maintaining the shield effect of the shield plate. Further, a recording apparatus and the like equipped with the shield plate fixing device are provided.

Further, the present invention relates to a liquid ejecting apparatus such as an ink jet recording apparatus and the like by which a liquid such as an ink or the like is discharged (ejected) from a head in order to perform recording (adhere the liquid) on a material to be recorded (material on which liquid is ejected). Additionally, the present invention relates to a shield plate fixing device within the liquid ejecting apparatus.

Here, the liquid ejecting apparatus refers not only to a recording apparatus in which an ink jet type recording head is used and recording is performed on a material by discharging an ink from the recording head, such as a printer, plotter, copier, facsimile, and the like, but may also be used in an apparatus in which a liquid instead of ink is ejected. In such configurations, both the liquid and the recording material correspond such that the liquid from the liquid ejecting head adheres to the material on which liquid is ejected.

Within the liquid ejecting head, besides the recording head, there may also be a color material ejecting head used to fabricate a color filter such as a liquid crystal display or the like. The liquid ejecting head may also comprise an electrode material (conductive paste) ejecting head used in electrode forming such as in an organic EL display or a face emission display (FED) or the like. Finally, the liquid ejecting head may comprise a living organic material ejecting head used in biochip fabrication, or a sample ejecting head used as an accurate pipette, or the like.

Another aspect of the shield plate fixing device according the invention is an electronic apparatus in which the mechanical section for performing operation in a main body housing, the electronic substrate for controlling operation shielded by two upper and lower shield plates above the mechanical section, and an upper housing for sealing an upper opening of the main body housing above the electronic substrate are respectively disposed in a stacked manner. The upper shield plate on which the upper housing is directly fitted is directly fixed to the main body housing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter a shield plate fixing device and a recording apparatus of the liquid ejecting apparatus type equipped with the shield plate fixing device according to the present invention will be described. By way of example, an ink jet printer 100 is illustrated as a best mode for performing the liquid ejecting apparatus and the recording apparatus of the invention, and is used to schematically illustrate the whole construction based on the accompanying drawings.

Figure 1:
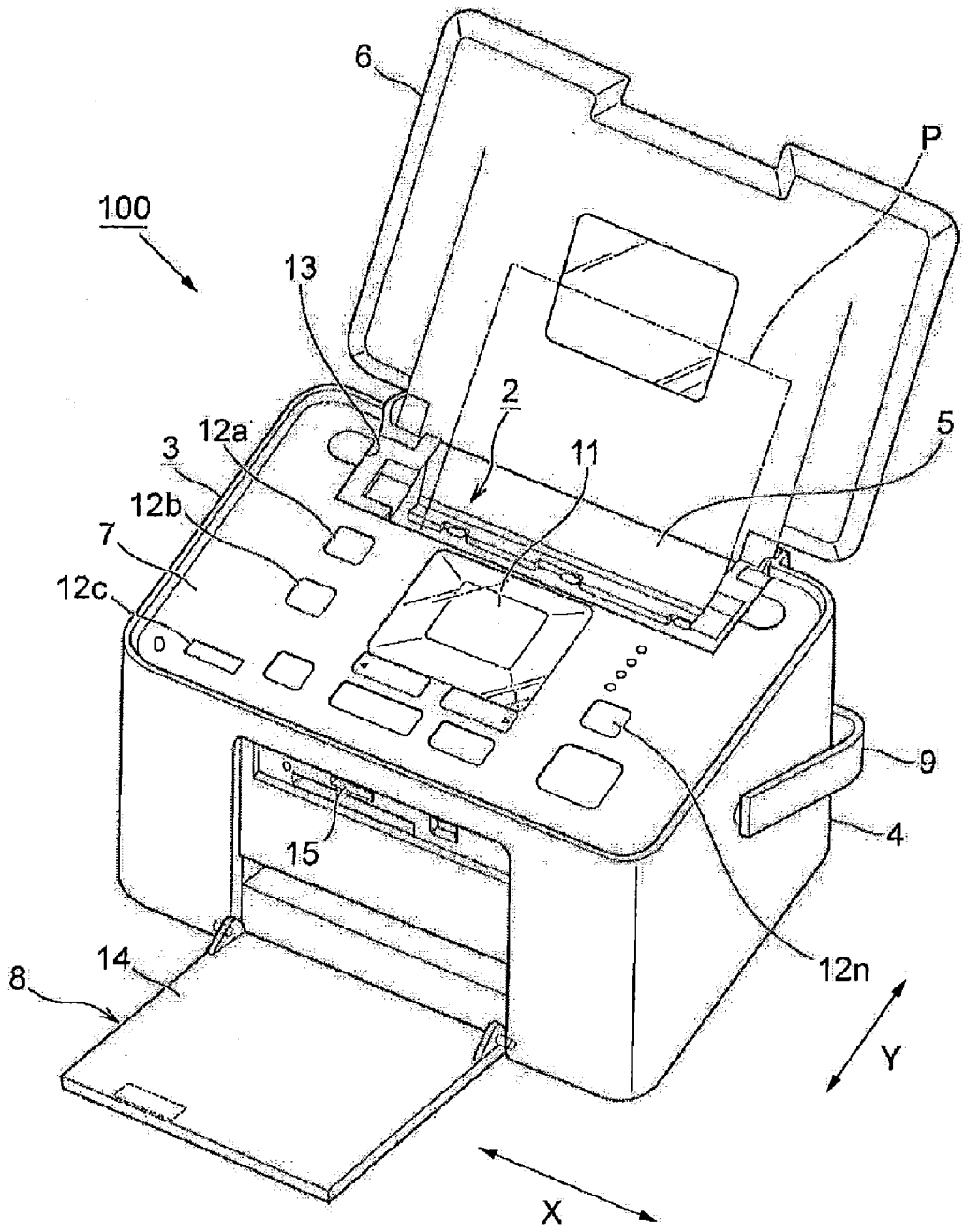
FIG. 1 is a perspective view showing an ink jet printer from an oblique front direction when in use.
Figure 2:
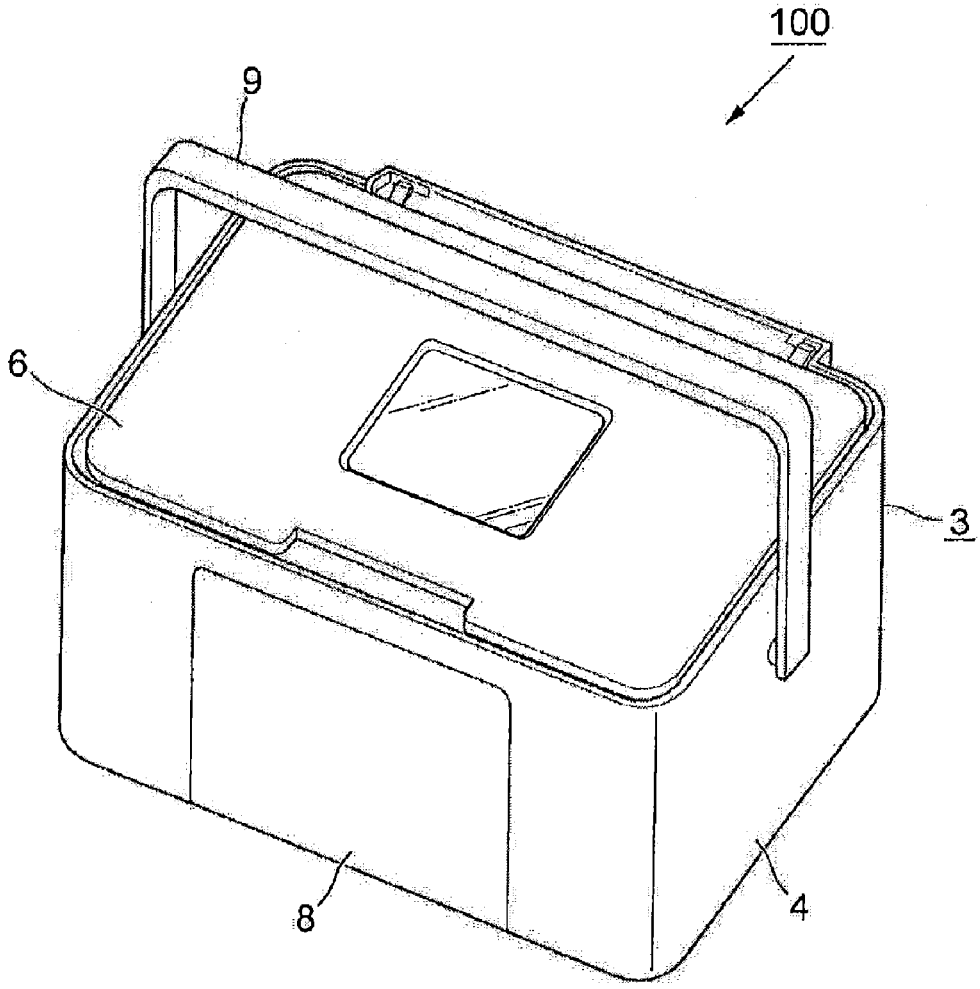
FIG. 2 a perspective view showing the ink jet printer from an oblique front direction when being carried.
Figure 3:
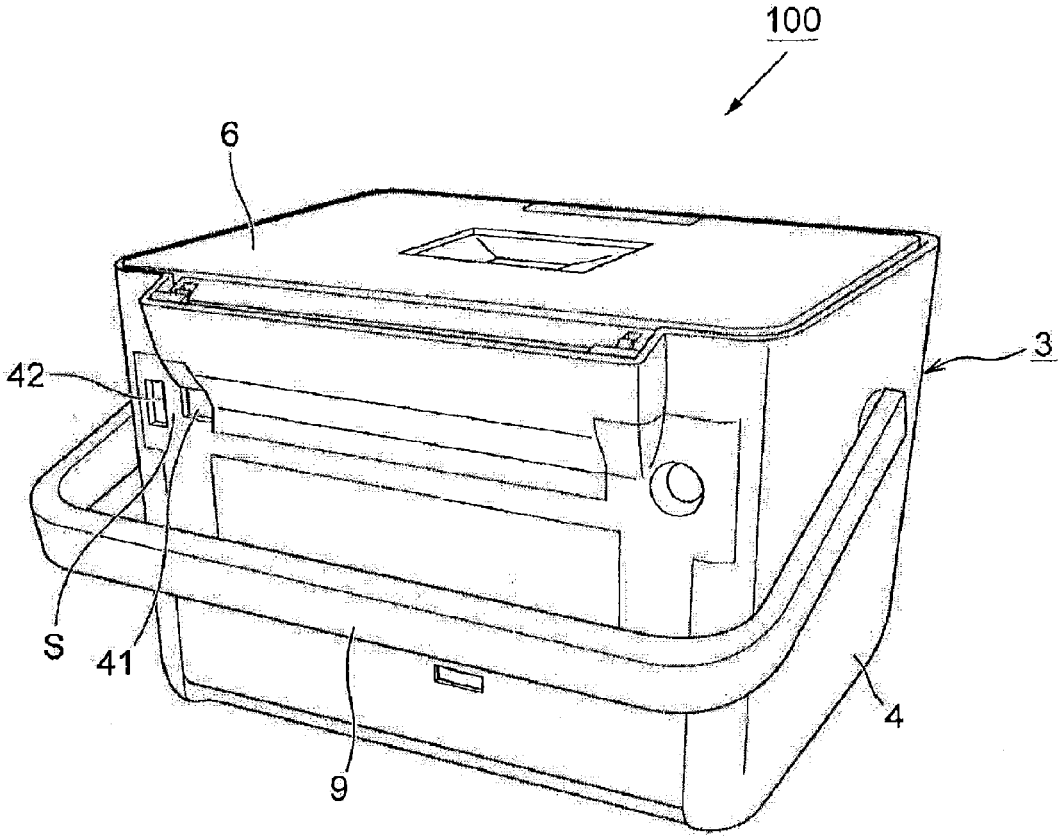
FIG. 3 is a perspective view showing an ink jet printer from an oblique rear direction.

FIG. 1 is a perspective showing an ink jet printer from an oblique front direction when ready for use. FIG. 2 is a perspective view showing an appearance of the ink jet printer from an oblique front direction when being carried. FIG. 3 is a perspective view showing an appearance of the ink jet printer from an oblique rear direction during use.

Note that the ink jet printer 100 described here is an ink jet printer which is extremely compact and easy to carry, having a relatively simple structure directed to, for example, recording onto a material P (hereinafter, also referred to as paper P) which is an example of a material on to which liquid is ejected having a size not more than 4×6 inch. In addition, the ink jet printer 100 is an in jet printer in which recording on the paper P can be separately performed without connecting to a personal computer, commonly referred to as a direct printer.

The ink jet printer 100 includes a main body casing 3 in the form of a square box as shown in FIGS. 1 and 2. The main body casing 3 includes a main body housing 4 in the form of a deep bottom vessel which seals the front surface, back surface, side surfaces, and bottom surface of the main body casing 3, together with a cover member 6 which seals the upper surface of the main body casing 3 when being carried as shown in FIG. 2. The cover member 6 also functions as a paper support for supporting an upper side portion of the paper P stuck in the upper direction of the feeding tray 5 when being used as shown in FIG. 1. An operation panel 7 is positioned below the cover member 6 when being carried as shown in FIG. 2 and serves as an example of an upper housing for sealing an upper opening of the main body housing 4. The main body casing 3 also includes a discharge stacker 8 which doubles as a front surface cover, and can freely open and close so as to open a part of the front surface of the main body housing 4 and seal the front surface opening. The main body casing 3 also includes a rotating carrying handle 9 having a portal shape connected to right and left side surfaces of the main body housing 4.

Then, a plurality of window sections 10*a*, 10*b*, 10*c*, . . . 10*n* (FIG. 4) are provided on the operation panel 7. A liquid monitor 11 is attached to the large window section 10*a*, and is positioned at the center. Various operation buttons 12*a*, 12*b*, 12*c*, . . . 12*n* are located in the other window sections 10*b*, 10*c*, . . . 10*n* so as to respectively project upward from the lower side. Further, a center portion of a rear portion of the operation panel 7 is cut out in a large rectangle manner and the cut out portion is to be a feed opening 13 for supplying a paper P to an auto feeding unit 2. Further, the discharge stacker 8 is equipped with rotation supports at right and left corners of lower portions and can be rotatably moved upward and downward in the range of about 90 degrees about the rotation supports. Further, the backside of the discharge stacker 8 is constructed so as to position the upper surface in the using state as shown in FIG. 1. Accordingly, the backside of the discharge stacker 8 is to be a placing surface 14 of the paper P after recorded.

Further, a memory card loading slot 15 capable of loading a memory card or the like in which image data photographed by a digital camera or the like is located at an upper portion of the front surface opening of the main body housing 4. The ink jet printer 100 has an extremely simple and neat design appearance in which the operation buttons 12*a*, 12*b*, 12*c*, . . . 12*n* and opening the discharge stacker 8 not exposed when being carried as shown in FIG. 2. Further, according to one embodiment, the ink jet printer 100 can not be operated in the carrying state and the ink jet printer 100 is constructed so as to be operated only after opening the covering member 6 and pushing the operation button 12*c* for opening the discharge stacker 8.

Assuming that the printer 100 is configured for use, when papers P are supplied to the ink jet printer 100, the papers P are received from the feeding tray 5 of the auto feeding unit 2 from the feeding opening 13, and are fed toward a paper transport path using a pinch and feed operation by a feeding roller and a hopper (not shown). Further, the paper P fed through the paper transport path is guided toward a recording position and transported by receiving a driving power from a transporting roller (not shown) with the bottom surface supported by a platen (not shown). Then, the desired recording is performed over the whole surface of the paper P by alternatively repeating reciprocal operations in the main scanning direction X while discharging an ink or other liquid through a recording head (not shown) which is held by a carriage (not shown). The transport operation of the paper P is performed by transporting the carriage in the sub scanning direction Y perpendicular to the main scanning direction X (corresponding to the transfer direction of the paper P). Finally, after recording the paper P, the paper P receives a driving force from a discharging roller (not shown) and is placed on the placing surface 14 of the discharge stacker 8 in the opened state.

Next, a shield plate fixing device 1 according to the present invention in an ink jet printer 100 with a grounding device 40 of an electronic component will be specifically described with reference to the accompanying drawings. It should be noted here that the ink jet printer 100 which is an object of application of the embodiment is an ink jet printer in which the main body housing 4 of the ink jet printer 100, the mechanical section 20 for performing operation within the main housing body 4, the electronic substrate 23 for controlling operation shielded by the two upper and lower shield plates 21 and 22, and the operation panel 7, main body housing are respectively disposed in a stacked manner.

(1) Shield Plate Fixing Device and Effect

Figure 4:
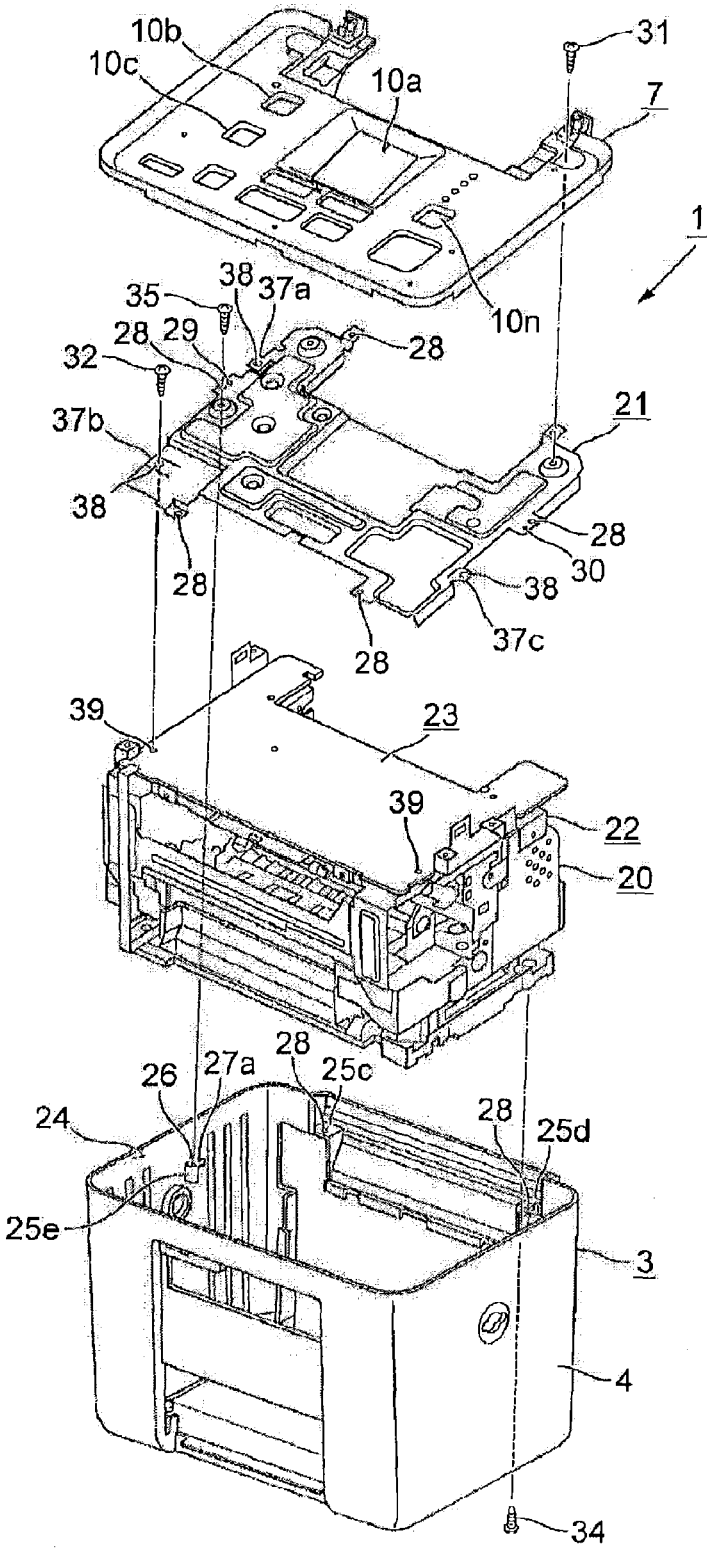
FIG. 4 is a disassembly perspective view showing the ink jet printer with a shield plate fixing device according to the present invention.
Figure 5:
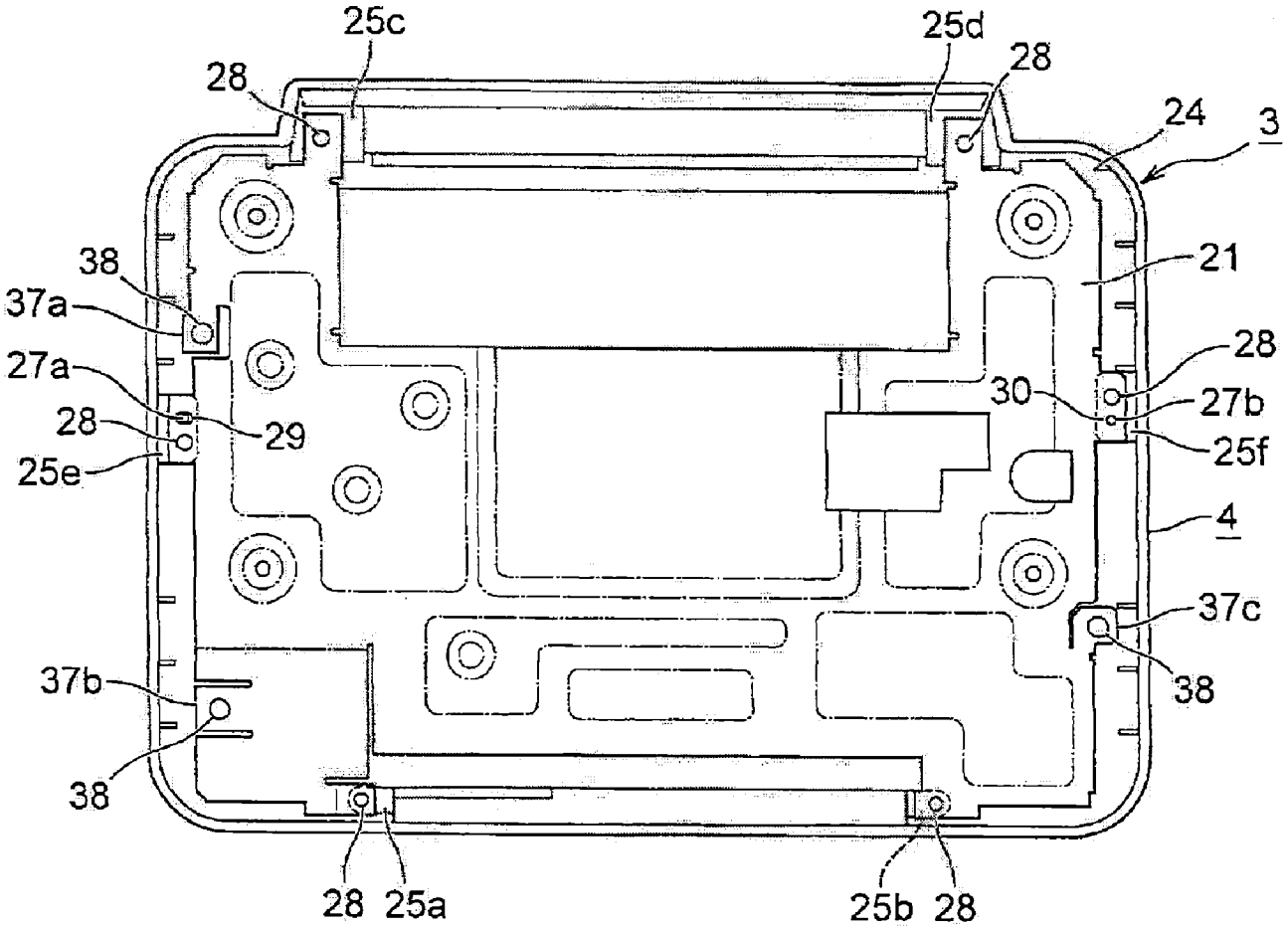
FIG. 5 is a plan view where an operation panel is detached from an ink jet printer.
Figure 6:
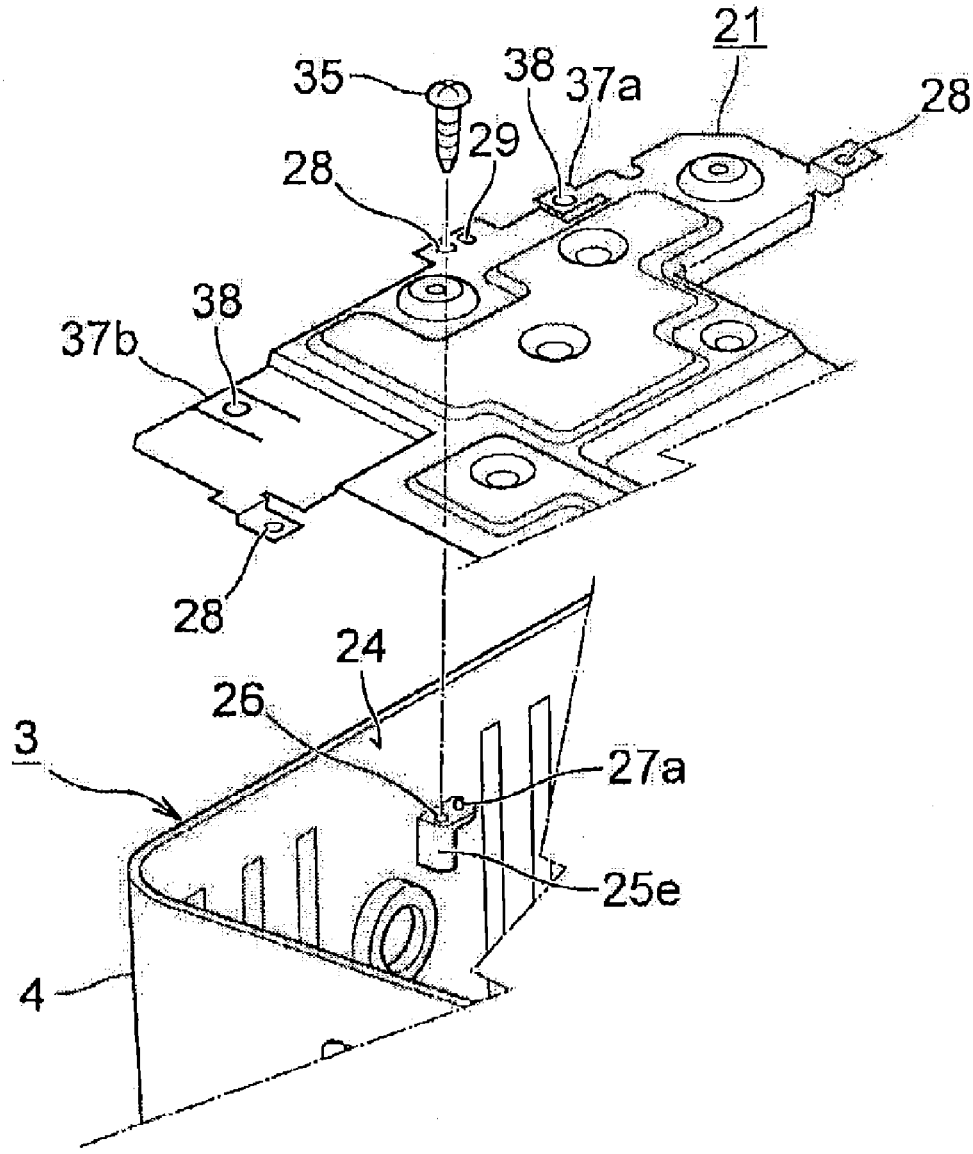
FIG. 6 is enlarged disassembly perspective view showing a peripheral view of the connecting portion of the upper shield plate and the main body housing.
Figure 7:
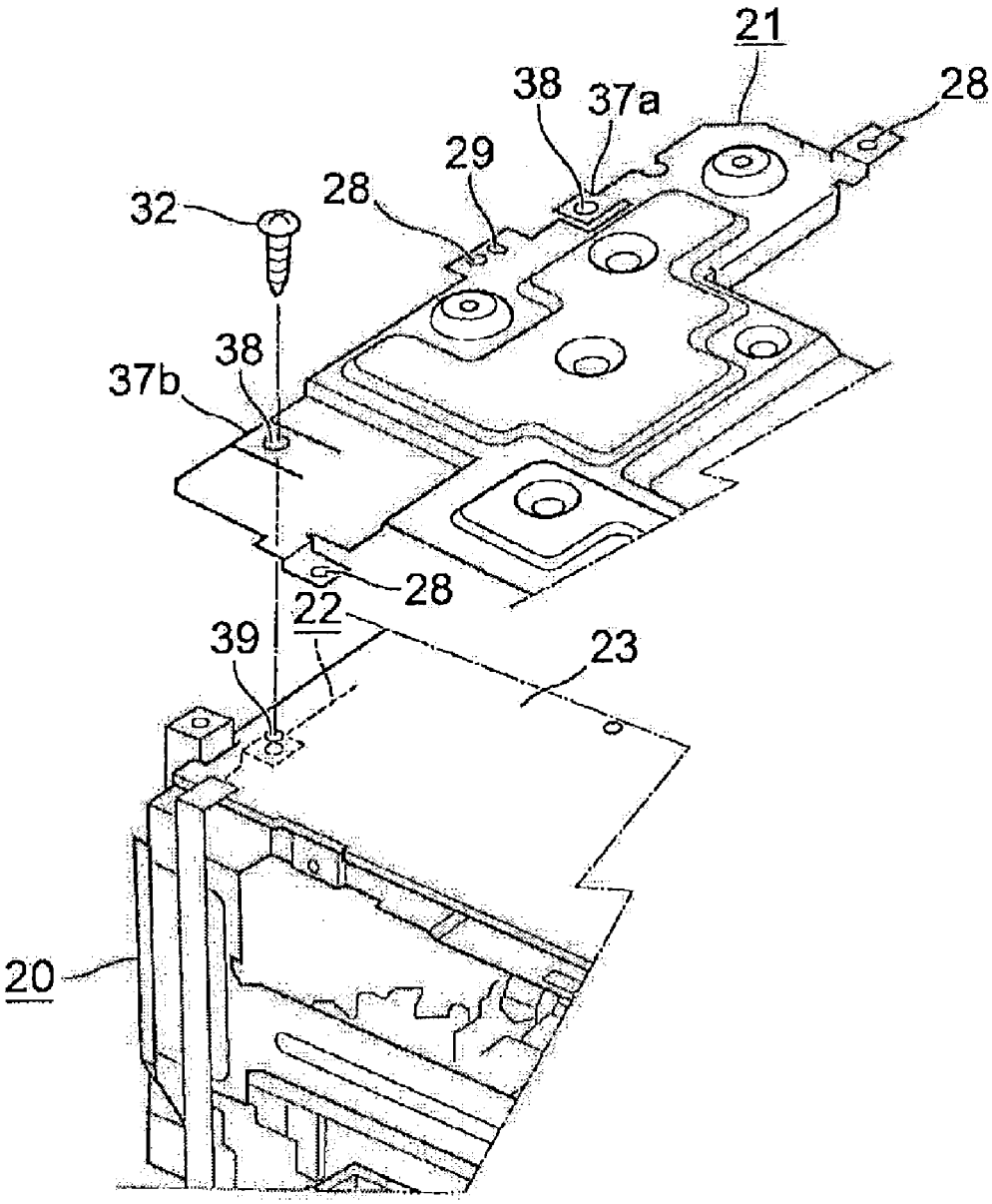
FIG. 7 is an enlarged disassembly perspective view showing a peripheral view of the connecting portion of the upper and the lower shield plates.
Figure 8B:
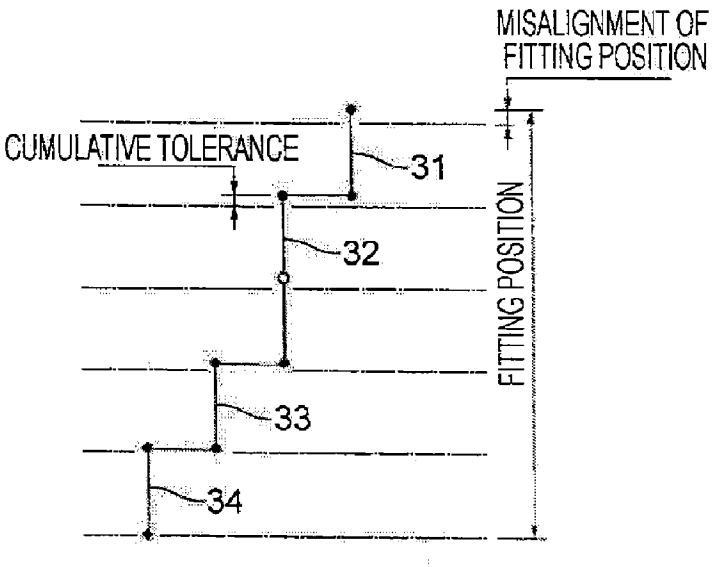
FIG. 8B is a pattern diagram showing the connecting structure between each component of an ink jet printer according to the prior art.
Figure 8A:
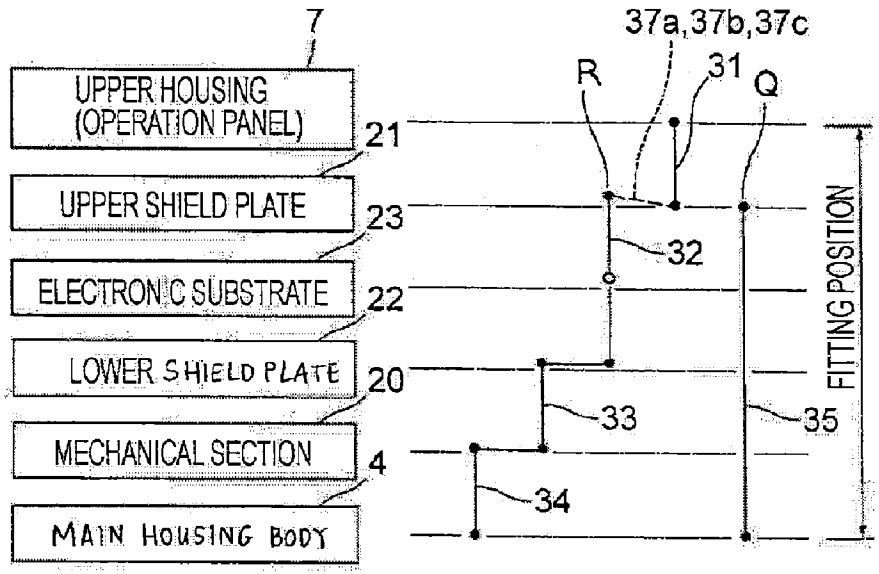
FIG. 8A is a pattern diagram showing the connecting structure between each component of the ink jet printer according to the present invention.

FIG. 4 is a disassembly perspective view showing an ink jet printer in which the shield plate fixing device of the invention is applied and FIG. 5 is plain view where the operation panel is detached from the ink jet printer. FIG. 6 is an enlarged disassembly perspective view showing a peripheral connecting portion of the upper shield plate and the main body housing and FIG. 7 is an enlarged disassembly perspective view showing a peripheral connecting portion of the upper shield plate and the lower shield plate. Moreover, FIG. 8A is a pattern diagram showing the connecting structure between each component of the ink jet printer to which the shield plate fixing device of the invention is applied. FIG. 8B is a pattern diagram showing the connecting structure between the various components of a conventional ink jet printer compared with FIG. 8A.

First, the connection structure between the operation panel (upper housing) 7, the upper shield plate 21, the electronic substrate 23, the lower shield plate 22, the mechanical section 20, and the main body housing 4 will be described based on FIG. 8A. First, the operation panel 7 and the upper shield plate 21 are connected by a fixing screw 31 as a first connecting member. Then, the upper shield plate 21 is connected with the lower shield plate 22 with the electronic substrate 23 interposed between them by a fixing screw 32 as a second connecting member. Further, the lower shield plate 22 is connected with the mechanical section 20 by a fixing screw 33 as a third connecting member, and additionally, the mechanical section 20 is connected with the main body housing 4 by a fixing screw 34 as a fourth connecting member.

Then, the upper shield plate 21 to which the operation panel 7 is directly fitted is directly fixed to the main body housing 4, meaning that the upper shield plate 21 is connected to the main body housing 4 without the connection passing through the mechanical section 20, lower shield plate 22, or electronic substrate 23. To be more specific, as shown in FIG. 5, six support shoulders 25*a*, 25*b*, 25*c*, 25*d*, 25*e*, and 26*f* for supporting the upper shield plate 21 are shown on upper portions of the inner wall surface 24 of the main body housing 4. The upper shield plate 21 may be directly fixed to the main body housing 4 by directly setting the upper shielding plate 21 on the six support shoulders 25*a*, 25*b*, 25*c*, 25*d*, 25*e*, and 26*f* and using a fixing screw 35 as a fifth connecting member.

The configuration of the respective six support shoulders 25*a*, 25*b*, 25*c*, 25*d*, 25*e*, and 25*f*, will be described in more detail below. Two support shoulders 25*a* and 25*b* are provided at the right and left of the inner wall surface of the front surface side of the main body housing 4, similarly two support shoulders 25*c* and 25*d* are provided at the right and left of the inner wall surface of the back surface side of the main body housing 4. One support shoulder 25*e* is located toward the rear direction from the center of the inner wall surface of the left surface side of the main body housing 4, and the one remaining support shoulder 25*f* is located near the rear direction from the center of the inner wall surface of the right surface side of the main body housing 4.

A screw opening 26 with a fixing screw 35 is provided for each of the support shoulders 25*a*, 25*b*, 25*c*, 25*d*, 25*e*, and 25*f* and engage pins 27*a* and 27*b* projecting upward are located in the support shoulders 25*e* and 25*f* on the right and left side surfaces. The fitting hole 28 has a diameter larger than that of a screw opening 26 and is located at each of the positions corresponding to the screw openings 26 of each of the supporting shoulders 25*a*, 25*b*, 25*c*, 25*d*, 25*e*, and 25*f* in the upper shield plate 21. Further, an elongated opening 29 for engaging the engaging pin 27*a* is located in the upper shield plate 21 at a position corresponding to the left side engaging pin 27*a*. Similarly, a positioning opening 30 for engaging the engaging pin 27*b* is located in the upper shield plate 21 at the position corresponding to the right side engaging pin 27*b*.

Further, elastic connecting pieces 37*a*, 37*b*, and 37*c* are formed as cantilevers, having deflection deformability are located at three portions in the upper shield plate 21. Then, a fitting hole 38 having a large diameter through which a fixing screw 32 is passed is located at each of the elastic connecting pieces 37*a*, 37*b*, and 37*c*. Further, the fixing screw 32 is formed out of an electrically conductive material, and the upper shield plate 21 and the lower shield plate 22 are connected as an electrically connected member by placing the fixing screw 32 through a screw opening (not shown) located in the lower shield plate 22, through the fitting hole 38 in the elastic connecting pieces 37*a*, 37*b*, and 37*c*, and through hole 39 provided to the electronic substrate 23.

Then, the upper shield plate 21 is directly fixed to the main body housing 4 as shown in FIG. 8A by fixing the shield plate fixing device 1 such that the influence of cumulative tolerance of the electronic substrate 23, lower shield plate 22, and the mechanical section 20 disappears. Note that the connecting point R of the upper shield plate 21 and the electronic substrate 23 and the lower shield plate 22 fluctuates by a cumulative tolerance of the electronic substrate 23, the lower shield plate 22 and the mechanical section 20, but the fitting position of the upper shield plate 21 remains at the fixing point Q of the support shoulders 25*a*, 25*b*, 25*c*, 25*d*, 25*e*, and 25*f* and does not fluctuate because the accumulated tolerance is absorbed by the deflection deformation of the elastic connecting pieces 37*a*, 37*b*, and 37*c*. Further, the upper shield plate 21 and the lower shield plate 22 are connected by the fixing screw 32 which is the second connecting member formed by an electrically conductive material, so that the two shield plates 21 and 22 are connected as an electrically connected member. Consequently, the shielding effect of the electromagnetic wave emitted from the electronic substrate 23 is maintained.

(2) Structure and Effect of Grounding Device of Electronic Component

Figure 9:
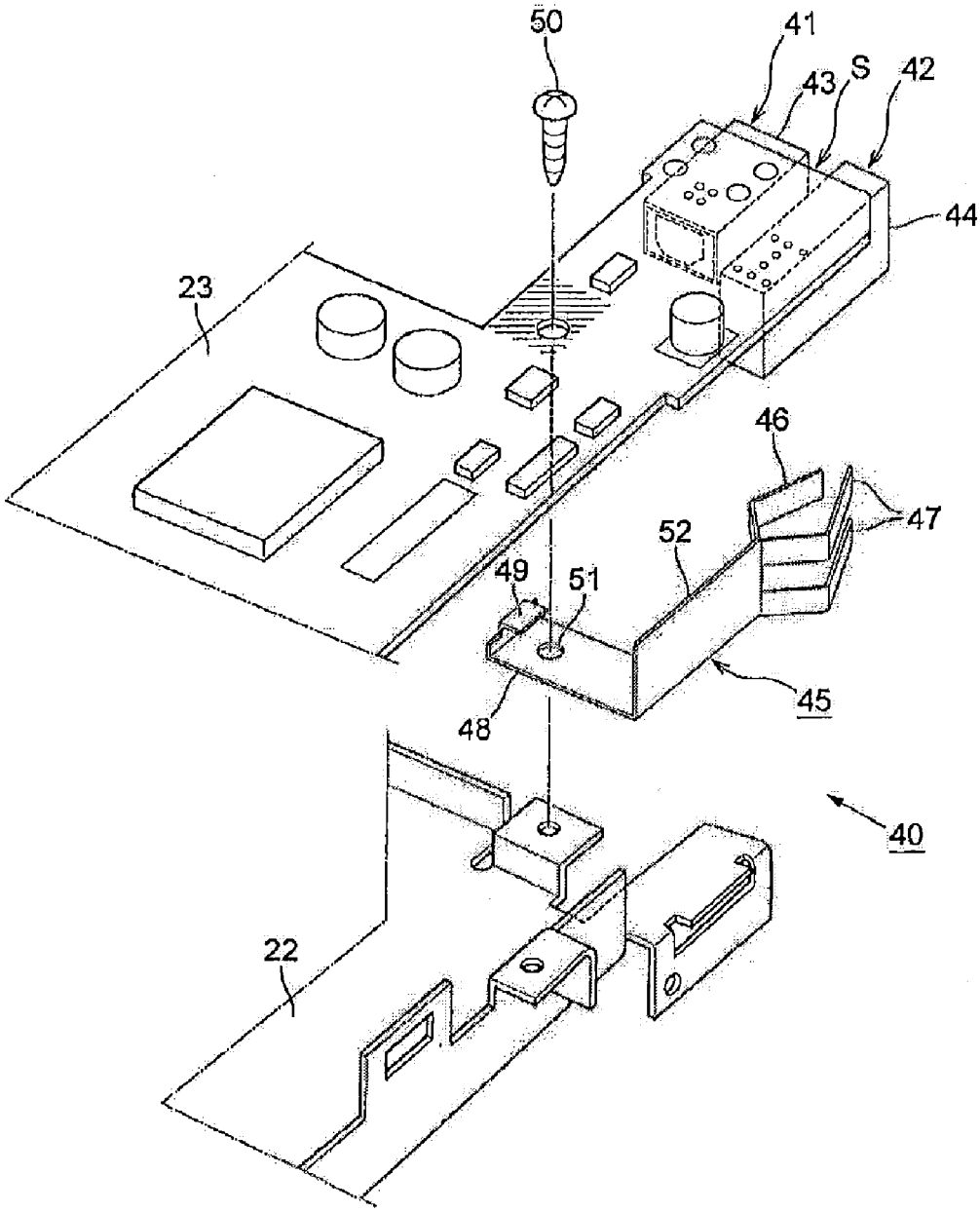
FIG. 9 is an enlarged disassembly perspective view showing a peripheral fitting portion of a grounding device of the electronic components.
Figure 10:
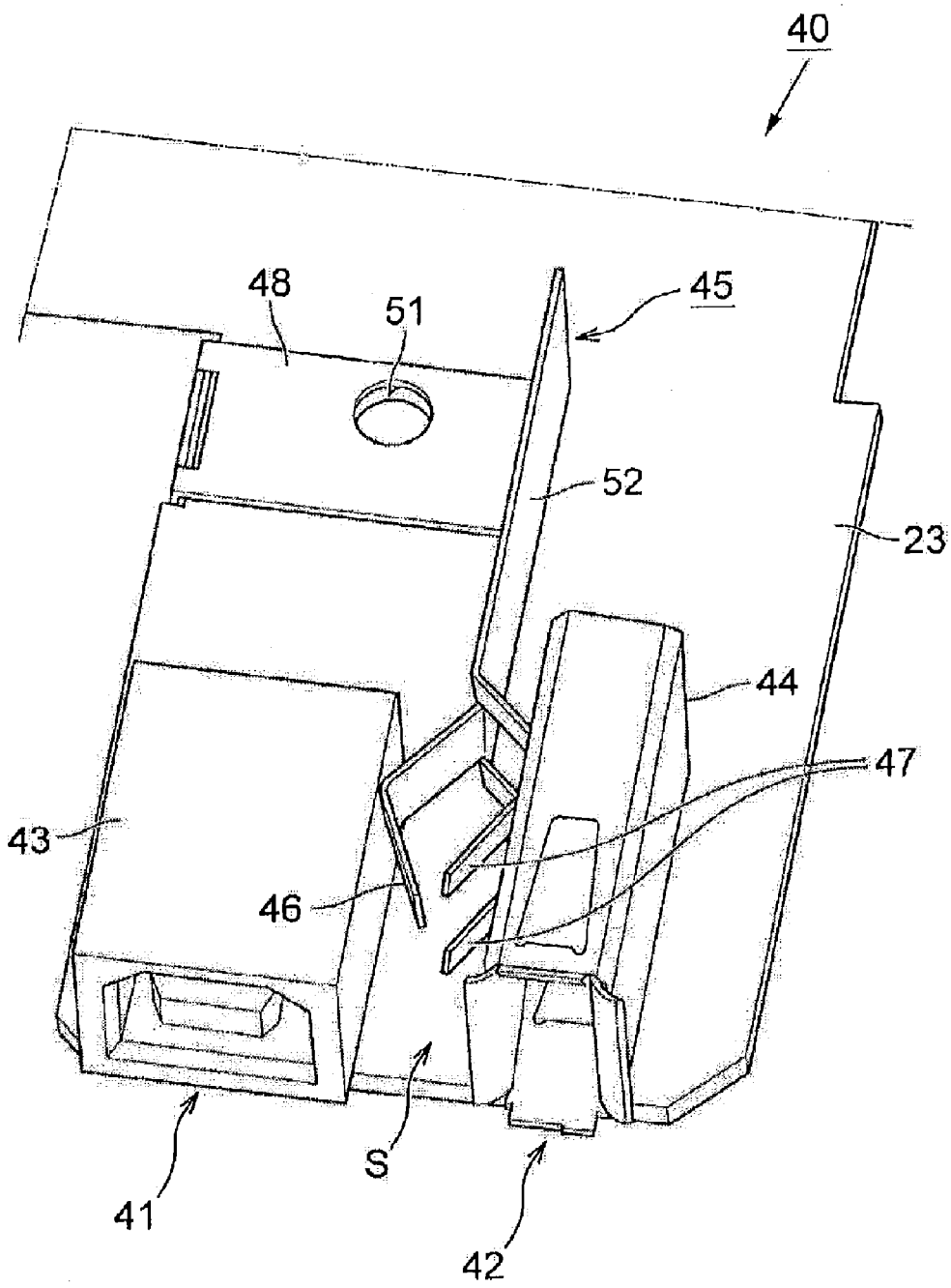
FIG. 10 is an enlarged underside perspective view showing a peripheral fitting portion of the grounding device of the electronic components.
Figure 11:
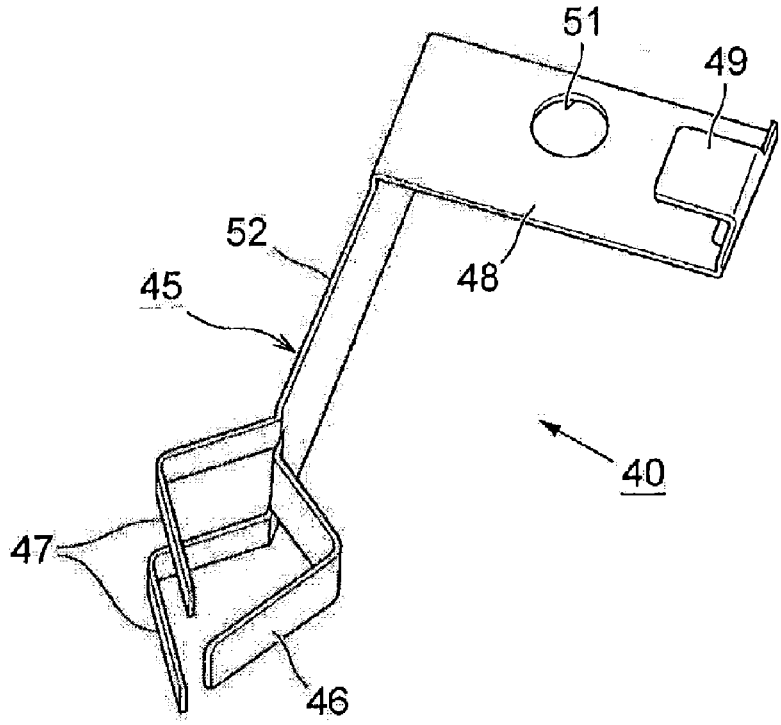
FIG. 11 is a perspective view showing a grounding device of electronic components.
Figure 12:
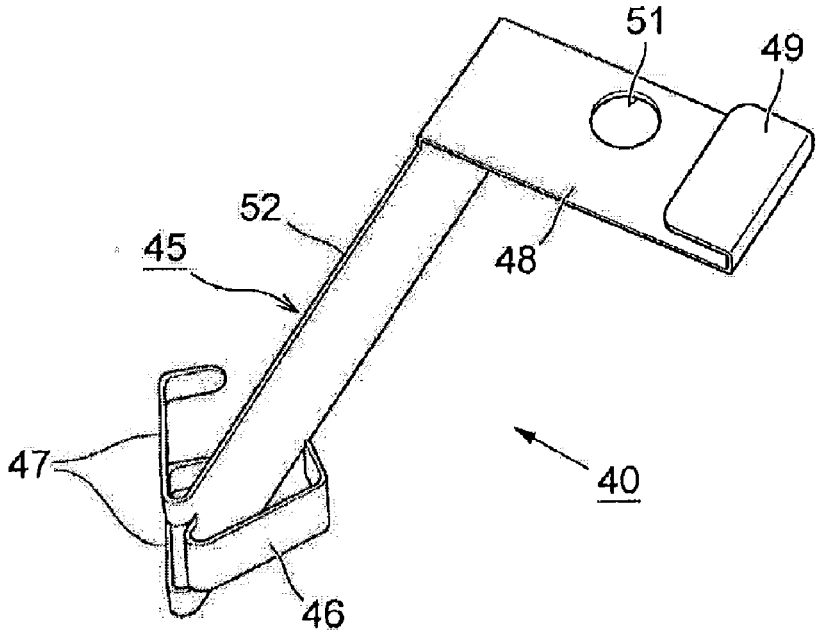
FIG. 12 is a perspective view showing another embodiment of a grounding device of electronic components.

FIG. 9 is an enlarged disassembly perspective view showing a peripheral fitting portion of a grounding device of electronic components and FIG. 10 is an enlarged perspective view showing a peripheral fitting portion of the grounding device of the electronic components where the electronic substrate is turned over. FIG. 11 is a perspective view showing a grounding device of electronic components and FIG. 12 is a perspective view showing another embodiment of a grounding device of electronic components. Further, FIG. 13A is a perspective view showing a first conventional type grounding device of electronic components and FIG. 13B is a perspective view showing a second conventional type grounding device of electronic components.

A USB interface connector 41 for connecting a USB cable and an EXT.I/F connector 42 are placed in parallel with a small space at a corner portion of one of the upper rear surface portion of the ink jet printer 100. Then, packages 43 and 44 in the form of housings formed from an electrically conductive material are placed for the electronic components 41 and 42 and two contacts 46 and 47 of a grounding spring member 45 for grounding placed, so that they contact the surfaces of the packages 43 and 44. Then, a grounding spring member 45 is used as a grounding device 40 of the electronic components.

Figure 13A:
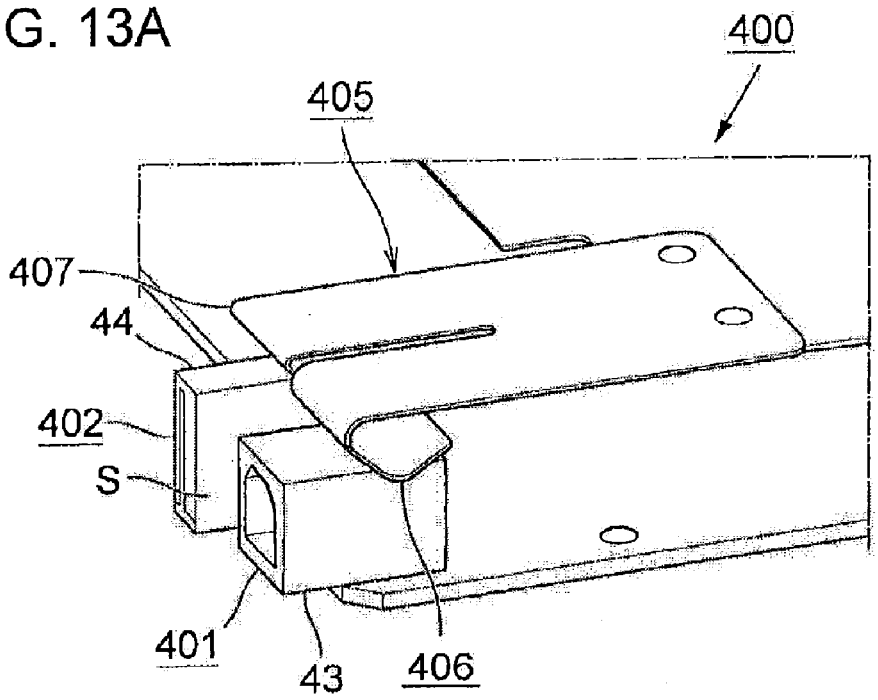
FIG. 13A is a perspective view showing a first conventional type grounding device of electronic components.
Figure 13B:
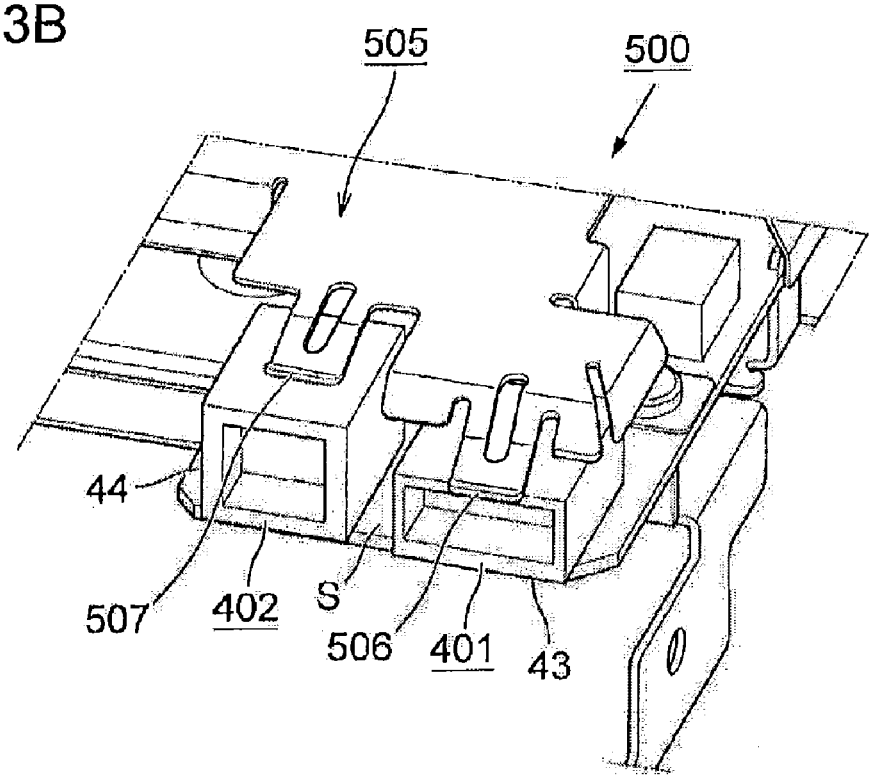
FIG. 13B is a perspective view showing a second conventional type grounding device of electronic components.

Note that in the conventional grounding devices 400 and 500 of electronic components, as shown in FIGS. 13A and 13B, the electronic components 401 and 402 are grounded by placing grounding spring members 405 and 505 outside (upper space in FIGS. 13A and 13B) the respective packages 43 and 44 with a space S as shown in FIGS. 13A and 13B. Accordingly, the contacts 406 and 407 or the contacts 506 and 507 which contact the packages 43 and 44 are bent in the same direction as the grounding spring member 405 or the grounding spring member 505, as shown in FIGS. 13A and 13B.

However, configurations where the grounding spring member 405 or 505 is placed outside the packages 43 or 44 requires that the space into which the grounding spring member 405 or 505 can is place is separately ensured, meaning that it is more difficult to downsize of the ink jet printer 100. Consequently, the downsizing of the ink jet printer 100 is facilitated by resolving the above mentioned problem by devising the shape of the grounding spring member 45 and the setting space thereof in the embodiment described below.

The grounding devices 40 of electronic components are constructed so that grounding is possible by projecting the contacts 46 and 47 of the grounding spring member 45 in the respective reverse directions and by introducing the contacts 46 and 47 into the space S between the packages 43 and 44 of the USB interface connector 41 and the EXT. I/T connector 42. The grounding spring member 45 is constructed by bending an electrically conductive flat plate material to an appropriate shape, like a plate spring. A proximal portion 48 of the grounding spring member 45 is formed to horizontally extend so as to follow the lower surface of the electronic substrate 23. The distal side of the proximal portion 48 is bent upward in a U-shaped manner. Further, the distal portion which is bent upward in the proximal portion 48 is a locking nail 49 locked to a frame portion of the upper surface of the electronic substrate 23. Further, a fitting hole 51 for receiving a fixing screw 50 for fixing the grounding of the spring member 45 and the electronic substrate 23 to the lower shield plate 22 is placed in the proximal portion 48.

An extending portion 52 extending from the proximal portion 48 of the grounding spring member 45 to the USB interface connector 41 and the EXT.I/F connector 42 is placed in a perpendicular posture bent in the upper direction by 90 degrees with respect to the proximal portion 48. In addition, one contact 46 for positioned at the center of the USB interface connector 41 and two contacts 47 are positioned at the upper and the lower sides of the EXT.I/F connector 42 are provided at the distal side of the extending portion 52 and are bent so as to project right and left. Then, the extending portion 52 proceeds into the space S between the packages 43 and 44 by passing the lower side of the electronic substrate 23. The contacts 46 and 47 utilize elastic force to contact the inner sides of the outer surfaces of the packages 43 and 44 positioned at right and left of the space S.

Then, the space S formed between the electronic components 41 and 42 can be utilized by applying a grounding device 40 for electronic components, which makes it possible to downsize the ink jet printer 100 by reducing the outside space of the packages 43 and 44. Further, reliable grounding can be provided more easily, by managing the space S between the two electronic components 41 and 42, together with the sizes of the contacts 46 and 47. Further, a temporal fixing of the grounding spring member 45 can be achieved by inserting the extending portion 52 of the grounding spring member 45 into the space S between the two electronic components 41 and 42 which allows downsizing and weight saving of the grounding spring member 45. Further, the assembling man-hours of the grounding spring member 45 may be reduced, which may provide improved productivity, reduction of components, and manufacturing costs.

The recording apparatus 100 is equipped shield plate fixing device 1 of the present invention as described above. However, changes, omissions, and the like may be made to the part structures without departing from the scope of the invention. For example, the application of the shield plate fixing device 1 is not limited to the recording apparatus of the ink jet printer 100 or other liquid ejecting apparatus. Further, the shield plate fixing device 1 can be widely applied to another various electronic apparatuses. Further, the number of the support shoulders provided to the main body housing 4 is not limited to six and may be optionally increased and reduced. Further, the size, shape and setting position of the support shoulders can be adequately changed. Further, the number, size, shape and setting position of the fitting holes 28 and 38 and the elastic connecting piece provided to the upper shield plate can be similarly adequately changed.

What is claimed is:

1. An electronic apparatus, comprising:

a mechanical section for performing an operation, the mechanical section being positioned in a main body housing;

an electronic substrate for controlling the operation, the electronic substrate being shielded by an upper shield plate and a lower shield plate; and an upper housing for sealing an upper opening of the main body housing, wherein:

the mechanical section, the lower shield plate, the electronic substrate, the upper shield plate, and the upper housing are respectively placed in a stacked manner; and the upper shield plate is directly fixed to the main body housing and to the upper housing.

2. The electronic apparatus according to claim 1, wherein a plurality of support shoulders for supporting the upper shield plate are formed on inner wall surfaces of upper portions of the main body housing, and the upper shield plate is fixed to the main body housing by directly setting the upper shield plate on the support shoulders.

3. The electronic apparatus according to claim 1, wherein the upper shield plate and the lower shield plate are connected by a connecting member formed from an electrically conductive material.

4. The electronic apparatus according to claim 3, wherein:

an elastic connecting piece in the form of a cantilever and having deflection deformability is placed in the upper shield plate; and the upper shield plate and the lower shield plate are connected through the elastic connecting piece.

5. The electronic apparatus according to claim 1, wherein the upper housing is an operation panel.

6. An electronic apparatus according to claim 1, wherein:

the electronic apparatus is a recording apparatus; and the operation is a recording operation.

7. An electronic apparatus according to claim 1, wherein:

the electronic apparatus is a liquid ejecting apparatus; and the operation is a liquid ejection operation.

* * * * *